United States Patent [19]

Clark et al.

[11] Patent Number: 4,707,407

[45] Date of Patent: Nov. 17, 1987

[54] SYNTHETIC WATER-DISPERSIBLE FIBER

[75] Inventors: John T. Clark, Greenville; Donald A. Shiffler, Kinston, both of N.C.

[73] Assignee: E. I. Du Pont de Nemours and Company, Wilmington, Del.

[21] Appl. No.: 842,790

[22] Filed: Mar. 27, 1986

Related U.S. Application Data

[63] Continuation-in-part of Ser. No. 721,347, Apr. 9, 1985, abandoned.

[51] Int. Cl.[4] ..... D02G 3/00

[52] U.S. Cl. ..... 428/361; 428/395; 428/397; 428/401

[58] Field of Search ..... 428/364, 375, 373, 374, 428/395, 397, 359, 361; 8/115.6; 264/177 F

[56] References Cited

U.S. PATENT DOCUMENTS

| | | | |
|---|---|---|---|
| 3,223,581 | 12/1965 | Sommer et al. | 162/157 |
| 3,394,047 | 7/1968 | Sommer et al. | 162/146 |
| 3,416,952 | 12/1968 | McIntyre et al. | 117/118 |
| 3,464,852 | 9/1969 | Caldwell et al. | 117/138.8 |
| 3,625,754 | 12/1971 | Dunn | 117/138.8 |
| 3,702,260 | 11/1972 | Jayne et al. | 117/100 |
| 3,914,488 | 10/1975 | Gorrafa | 428/397 |
| 4,104,222 | 8/1978 | Date et al. | 260/29.2 |
| 4,134,882 | 1/1979 | Frankfort et al. | 528/309 |
| 4,179,543 | 12/1979 | Hawkins | 428/361 |
| 4,195,051 | 3/1980 | Frankfort et al. | 264/176 F |
| 4,294,883 | 10/1981 | Hawkins | 428/361 |
| 4,297,414 | 10/1981 | Matsumoto | 428/400 |

FOREIGN PATENT DOCUMENTS 2124574 9/1972 France .

OTHER PUBLICATIONS

Japanese Patents Gazette (Derwent)-11-17-82—Teijin KK-J5/7139-600.

Japanese Patents Gazette (Derwent)-2-29-84—Teijin KK-J5/8208-499-A.

*Primary Examiner*—Lorraine T. Kendell

[57] ABSTRACT

Water-dispersible synthetic fiber of scalloped-oval cross-section to promote dispersibility, and so better uniformity, softer feel and more opacity to the resulting wet-laid fabrics.

9 Claims, 2 Drawing Figures

SYNTHETIC WATER-DISPERSIBLE FIBER

CROSS-REFERENCE TO RELATED APPLICATION

This application is a continuation-in-part of application Ser. No. 721,347, filed April 9, 1985, and now abandoned.

TECHNICAL FIELD

This invehtion concerns new synthetic polymeric water-dispersible fiber, particularly of poly(ethylene terephthalate), and its preparation.

BACKGROUND OF INVENTION

There has been increased interest in recent years in water-dispersible synthetic fiber, especially of polyester fiber. Such water-dispersible fiber is used in various non-woven applications, including paper-making and wet-laid non-woven fabrics, sometimes as part of a blend, often with large amounts of wood pulp, or fiberglass, but also in applications requiring only polyester fiber, i.e., unblended with other fiber. This use, and the requirements therefor, are entirely different from previous more conventional use as tow or staple fiber for conversion into textile yarns for eventual use in woven or knitted fabrics, because of the need to disperse this fiber in water instead of to convert the fiber into yarns, e.g., by processes such as carding, e.g. in the cotton system. It is this requirement for water-dispersibility that distinguishes the field of the invention from previous, more conventional polyester staple fiber.

Most such water-dispersible polyester fiber is of poly(ethylene terephthalate), and is prepared in essentially the same general way as conventional textile polyester staple fiber, except that most water-dispersible polyester fiber is not crimped, whereas any polyester staple fiber for use in textile yarns is generally crimped while in the form of tow, before conversion into staple fiber. Thus, water-dispersible polyester fiber has generally been prepared by melt-spinning the polyester into filaments, combining the filaments to form a tow, drawing, applying a suitable coating to impart water-dispersible properties, generally in the same way as a finish is applied to a tow of conventional textile filaments, and then, generally without any crimping (or with imparting only some mild wavy undulations in some cases to provide extra bulk and a three-dimensional matrix), converting the tow into staple. Some prior polyester staple fiber has been prepared in uncrimped form, e.g. for use as flock in pile fabrics, but for such use, water-dispersibility has not been required.

Polyester fibers are naturally hydrophobic, so it is necessary to apply to the polyester a suitable coating, as disclosed by Ring et al. in U.S. Pat. No. 4,007,083, Hawkins in U.S. Pat. Nos. 4,137,181, 4,179,543 and 4,294,883, and Viscose Suisse in British Patent No. 958,350, to overcome the inherent hydrophobic character of the polyester fiber without creating foam or causing the fibers to flocculate. It is this coating that has distinguished water-dispersible polyester fiber from more conventional polyester staple fiber, rather than any inherent characteristic feature of the polyester itself, or of its shape, such as the cross-section. Heretofore, so far as is known, the cross-section of all commercial water-dispersible polyester fiber has been round. Indeed the cross-section of most commercial polyester staple fiber for other uses has generally been round, because this has been preferred.

Although, hitherto, most synthetic polymeric water-dispersible fiber has been formed of polyester, being inexpensive and plentiful, increasing amounts of polyolefins and polyamides are beginning to be used for water-dispersible fibers, and so the invention is not limited only to polyesters, but covers other synthetic polymers.

SUMMARY OF INVENTION

According to the present invention, there is provided new synthetic polymeric water-dispersible fiber, especially polyester fiber, characterized in that the fibers are of scalloped-oval cross-section.

A scalloped-oval cross-section has been used heretofore for other polyester fibers, as described herein. Other than the cross-section, the water-dispersible fiber of the invention may be essentially similar to prior water-dispersible polyester or other synthetic polymer fibers, although the advantages described hereinafter may provide the opportunity for additional modifications. The invention will be described hereinafter with special reference to polyester fiber, although it will be recognized that other synthetic polymers, such as polyamides and polyolefins, may also be used.

The fibers of the invention may be made conveniently by melt-spinning and drawing polyester filaments of appropriate denier per filament (dpf), and applying thereto a suitable coating to impart water-dispersible characteristics. The filaments are then generally cut into staple of whatever length is desired for the end-use contemplated.

The use of a scalloped-oval cross-section for the water-dispersible fiber of the invention has, surprisingly, been found to promote dispersibility, in comparison with a round cross-section, and this imparts to the resulting wet-laid fibers better uniformity, a softer feel, more opacity and good permeability, as will be seen in the Example.

DISCLOSURE OF THE INVENTION

As indicated above, a scalloped-oval cross-section has already been used for more conventional polyester staple fiber, that has been spun into filaments and drawn, cut, converted into spun yarn, and used in woven or knitted fabrics. Such fiber has not had the water-dispersible characteristics required for this invention. Similarly, polyester filaments having a scalloped-oval cross-section are already known from Gorrafa U.S. Pat. No. 3,914,488, which suggested use in fur-like fabrics. Oriented polyester filaments of scalloped-oval cross-section have also been described by Frankfort et al. in U.S. Pat. Nos. 4,134,882 and 4,195,051, having been prepared by spinning at a very high speed (6,000 ypm), which high speeds could also be used to prepare oriented polyester filaments as a substrate for applying thereto a suitable coating to impart water-dispersible characteristics, and thereby obtain water-dispersible fiber according to the invention. Also, Franklin, U.S. Ser. No. 664,803 filed Oct. 25, 1984, suggests partially oriented filaments of scalloped-oval cross-section for use as draw-texturing feed yarns. None of this art concerns the field of the present invention. However, the polyester filamentary substrates for making the water-dispersible fiber of the invention may be prepared by the techniques described therein, or by appropriate modifications of these or other known techniques of making polyester filaments of non-round cross-section.

Figure 1:
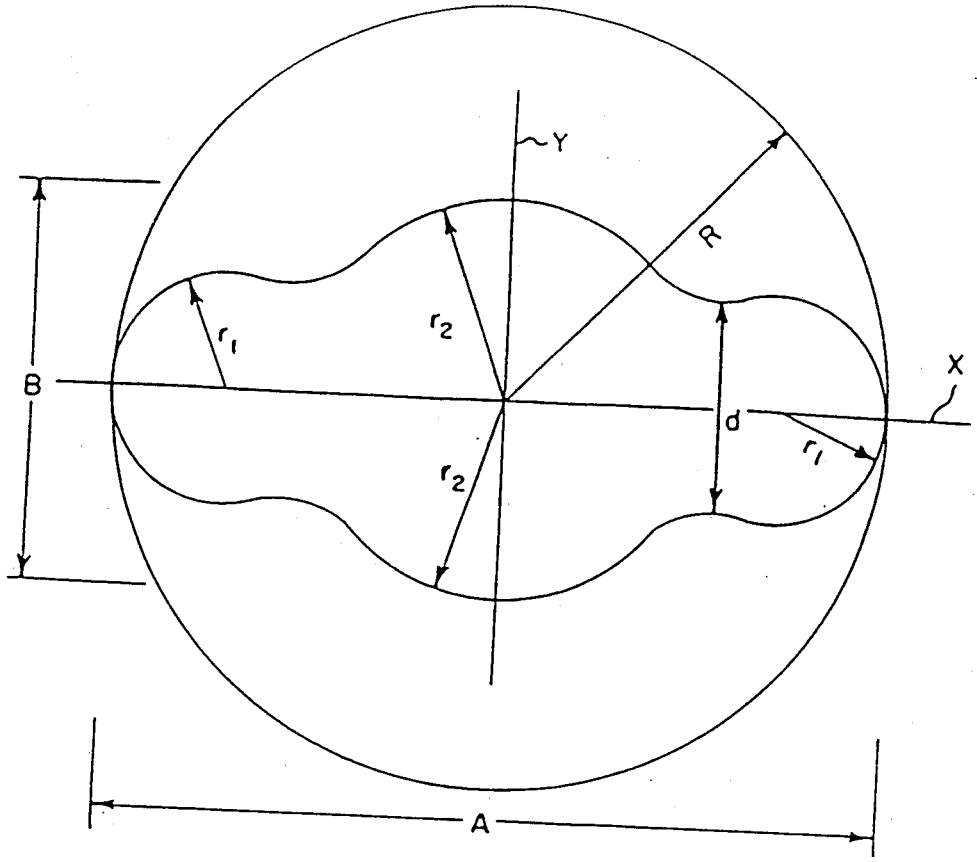
FIG. 1 shows a scalloped-oval cross-section for a stylized fiber according to the invention.

Gorrafa U.S. Pat. No. 3,914,488 and Franklin U.S. Ser. No. 664,803 disclose parameters for a scalloped-oval cross-section and FIG. 1 is essentially as shown therein. Thus, a scalloped-oval is of essentially oval shape, with a significant difference between the lengths of major and minor axes, and differs significantly from prior art round and multi-lobal filaments in this respect, so that it would be misleading herein to consider all four rounded portions of the scalloped-oval as lobes (as did Gorrafa) in view of the terminology used in other prior art for symmetrical multi-lobal cross-sections. However, preferred dimensions, essentially as described by Gorrafa and by Franklin, may be characterized as follows:

Considering FIG. 1, the cross-sectional configuration of fibers may be determined from a photomicrograph of the fiber cross-section.

The length of cross-section along the major axis X is indicated by A, which is also 2R, the circumscribing radius for the cross-section. The width of the cross-section along the minor axis Y is indicated by B. The ratio of length to width of the cross-section is A/B.

In the melt-spinning of filaments, the polymer tends to flow so as to produce smooth curves or combinations of smooth curves and straight lines in the periphery of the cross-section. For the purpose of measurement, the periphery may be considered to be composed of straight lines and arcs of circles. Using this concept, filaments of the invention have a lobe located at each end of the major cross-sectional axis, the extreme portion of the lobe being an arc of a circle, and being preferably more than a semicircle. The radius of each lobe tip is indicated by $r_1$. Likewise, at each end of the minor axis Y of the cross-section, there is another arc, whose radius is indicated by $r_2$. While FIG. 1 shows the centers of curvature for both arcs at the same point on the minor axis, this is not essential. The centers of curvature may be separated, for example, as described by Gorrafa. The tip radius ratio for the lobes on the major axis is $r_1/R$ and for the extremities of the minor axis is $r_2/R$.

Another feature of the cross-section is the distance d which is the distance between two scallopings measured across the major axis of the fiber cross-section, as described by Gorrafa and by Franklin.

Preferably, dimensions are in approximately the following proportions:—the ratio of length to width A/B of the cross-section from 1.4 to 2.4, tip radius ratio $r_1/R$ for the lobes on the major axis between 0.20 and 0.45, and the tip radius ratio $r_2/R$ on the minor axis from 0.8 to 2.1 times the tip radius ratio $r_1/R$. The cross-section must be properly scalloped to provide the desirable properties of the invention; for this reason, the ratio $d/2r_1$, is preferably from about 0.6 to 1.0.

While the above features may appear to be complicated, they are quite simple to measure on enlarged photomicrographs of cross-sectional views.

The preparation of the polyester staple fiber is otherwise conventional, involving the steps of melt-spinning polymer into filaments, collecting the filaments into a tow, drawing the tow, and applying a suitable coating to impart water-dispersible characteristics. If low shrinkage is desired, the drawn filaments are generally annealed.

Selection of an appropriate coating to promote water-dispersibility is important, and more of such coating is generally required than for comparable weights of fiber of round cross-section of similar dpf, because of the larger surface area of the periphery of the scalloped-oval cross-section. It is especially important to provide good boundary lubrication properties. For this reason, an ethoxylated coating is preferred.

Suitable coatings are disclosed in Hawkins, U.S. Pat. Nos. 4,137,181, 4,179,543 and 4,294,883 and also in U.S. Ser. No. 842,789, also filed Mar. 27, 1986 in the names of van Issum and Schluter, disclosing the use of a synthetic copolyester of poly(ethylene terephthalate) units and poly(oxyalkylene) of groups derived from a poly(oxyalkylene) glycol having an average molecular weight in the range of 300 to 6,000, as disclosed, e.g. in McIntyre, et al. U.S. Pat. Nos. 3,416,952, 3,557,039 and 3,619,269, referred to therein; other useful segmented copolyesters are disclosed in Raynolds, U.S. Pat. No. 3,981,807; all these disclosures are incorporated herein by reference.

Such polyester fiber is generally prepared first in the form of a continuous filamentary uncrimped tow or, if extra bulk is required, and a more three-dimensional matrix, the filaments may be provided with mild wave-like undulations by a mild crimping-type process, and the uncrimped or mildly wave-like filaments are cut to the desired cut length, i.e. to form the water-dispersible fiber, which is generally sold in the form of bales, or other packages of cut fiber. Suitable cut lengths are generally from about 5 to about 90 mm (¼ to 3 inches), generally up to 60 mm (2½ inches), and of length/diameter (L/D) ratio from about 100:1 to about 2000:1, preferably about 150:1 to about 2000:1, it being an advantage of the invention that good performance has been obtainable with preferred water-dispersible fiber of the invention with an L/D ratio higher than we have considered satisfactory with prior art water-dispersible polyester fiber. A suitable denier per filament is generally from about 0.5 to about 20. The coating is generally present in amount about 0.04 to about 1.0% of the weight of fiber (OWF%).

There is also provided a process for preparing such water-dispersible polyester fiber, comprising the steps of melt-spinning the polyester into filaments of scalloped-oval cross-section, forming a tow of such filaments, drawing, and then coating the filaments in the tow with such synthetic copolyester, and, at an appropriate time, converting such coated filaments into staple fiber.

The coating is preferably cured on the filaments by heating the coated filaments, or the resulting staple fiber, if desired, to a temperature of about 100° to about 190° C. to improve durability.

The invention is further illustrated in the following Example, in which all parts and percentages are by weight, unless otherwise indicated, and OWF is (solids) "of weight of fiber". Reference is made to several measurements of yarn properties, such as tensile properties (tenacity and elongation-to break), which are measured according to the methods described in Frankfort et al. U.S. Pat. No. 4,134,882. It will be understood that other conditions can be used e.g., other designs of orifice, such as are shown by Gorrafa, U.S. Pat. No. 3,914,488.

EXAMPLE

The following fibers, Fiber A, a comparison of round cross section, and Fiber X, a fiber of the invention of scalloped-oval cross-section, were both spun from poly(ethylene terephthalate) of intrinsic viscosity 0.64, containing 0.3% $TiO_2$ as a delusterant.

Fiber A was spun at 1600 ypm into filaments with conventional radial air quenching using a 900 hole spinneret, with round holes 0.015 inches in diameter and capillary length of 0.030 inches, a 270° C. block, and polymer throughput 68.2 pounds/hour. Denier per filament was 3.67. Fiber A was then oriented by running over a set of feed rolls at 29.3 ypm, followed by a set of draw rolls at 80.0 ypm, and delivered to a conveyer by puller rolls at 80.1 ypm. Between feed roll sections the filaments were treated in a 45° C. water bath. Between feed and draw rolls the rope was sprayed with water at 98° C. Between draw and puller rolls a commercial water-dispersible coating (50/50 mixture of potassium salt of mono and diacid phosphate esters of lauryl alcohol/tallow alcohol ethoxylated with 25 moles of ethylene oxide) was applied. The filaments were then relaxed free in an oven at 150° C. for 6 minutes.

Figure 2:
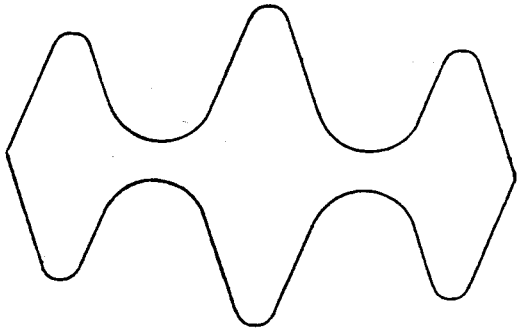
FIG. 2 shows a typical spinneret orifice for spinning filaments of the invention.

Fiber X was produced in a similar manner to item A except that 1054 filaments of 2.98 dpf and scalloped-oval cross-section were spun through capillaries as shown in FIG. 2, with block temperature 274° C., and throughput 67 pounds/hour. Roll speeds for the orientation were feed rolls 34.1 ypm, draw rolls 80.2 ypm and puller rolls 79.1 ypm, and a higher level of water-dispersible coating was used to offset the scalloped oval's approximately 13% higher surface area.

Fiber X cross-sections had dimensions in the following average proportions: $A/B=1.57$, $r_1/R=0.38$, $r_2/R=0.42$ and $d/2r_1=0.83$.

The properties of the drawn coated filaments are compared in Table 1.

TABLE 1

| | Sample | |
|---|---|---|
| | A | X |
| Cross-section | Round | scalloped-oval |
| dpf | 1.47 | 1.51 |
| coating OWF (%) | 0.4 | 0.7 |
| Boil-off shrinkage (%) | 1.0 | 0.2 |
| Dry heat shrinkage (196° C.) (%) | 2.45 | 3.1 |
| Tenacity at break (g/d) | 4.5 | 4.7 |
| Elongation at break (%) | 42 | 36 |
| Tenacity at 2% elongation (g/d) | 0.93 | 0.90 |

Both types were cut to form water-dispersible fiber of ¼, ⅜, ½ and ¾ inch cut lengths and were tested on an inclined wire Fourdrinier machine. Fibers were dispersed for three minutes in a small pulper at 0.75% consistency (lbs. fiber per 100 lbs. slurry, or furnish). The cylindrical pulper was approximately 3 feet in diameter by 6 feet deep. Fibers were then mixed with unrefined sulphite pulp to form a 50% polyester blend and diluted to 0.1% consistency in a 10 cubic meter stock tank. This stock was further diluted in the headbox of the machine to 0.0143% consistency and formed into a 0.5 meter wide wet lay nonwoven fabric at 20 meters/minute. A spray of an acrylic binder, Acronyl 240D was spray applied at the end of the Fourdrinier wire. The fabric was then cured in a through air drier at 150° C. Finished fabric weight averaged 40 grams/square meter.

Dispersion quality can be judged by the uniformity of the fabric produced from a given sample. As cut length increases, the uniformity of the fabric can generally be expected to suffer significantly. However, great advantages can result from using a longer fiber because the fabric tear strength increases, for example. In practice, therefore, a fabric producer will generally wish to use the longest fiber that will meet his uniformity standards. Thus, a longer fiber with improved, or equivalent uniformity would be preferred. Fabric samples from Fibers A and X were independently shown to a panel of 10 persons (which was evenly divided between men and women), who were asked to rank the fabrics in terms of visual uniformity with the results shown in Table 2, the most uniform being ranked at 1, i.e. the lowest score.

TABLE 2

| Rank | Fiber | Cut Length, inches | Average score |
|---|---|---|---|
| 1 | X | ¼ | 1.1 |
| 2 | A | ¼ | 2.0 |
| 3 | X | ⅜ | 2.9 |
| 4 | X | ½ | 4.4 |
| 5 | A | ⅜ | 4.6 |
| 6 | A | ½ | 6.2 |
| 7 | X | ¾ | 6.8 |
| 8 | A | ¾ | 7.0 |

As can be seen, each scalloped-oval fabric (X) scored better, i.e. was preferred for fabric uniformity over its round counterpart at the same cut length. Indeed, the ½ inch Item X was actually preferred, by a narrow margin, over its signficantly shorter ⅜ inch Item A counterpart.

A common defect in wet lay nonwoven fabrics is two clumps of fibers joined together by a single overlength. These defects are called dumbbells, or, if single ended, clumps. The number of such defects was determined for known weights of fabric for all cut lengths of both fibers. On the average, Item X, the scalloped-oval, had 44% fewer defects/100 grams fabric than the control. This may possibly be caused by the assymetric nature of the fiber bending modulus, which limits the freedom of the scalloped-oval long fibers to respond to swirls in the white water.

Standard physical properties were measured for the set of fabrics at Herty Foundation, Savannah, Ga. Compared each time to Fiber A as 100%, Fiber X had the following average properties:

| | |
|---|---|
| Air Permeability, Gurley | 101% |
| Opacity, ISO 2471 | 108% |
| Bulk, TAPPI T410 om-83 and T411 om-83 | 96% |
| Tensile Strength, TAPPI T494 om-81 | 112% |
| Tensile Stretch, TAPPI T494 om-81 | 93% |
| Tear Strength, TAPPI T414 om-82 | 100% |

On balance, Item X exhibited advantages in the important areas of higher opacity and higher tensile strength, with minor sacrifices in tensile stretch and bulk. The fabrics of Item X also have a pleasant soft hand.

When used with the appropriate water-dispersible coating in appropriate amount, the scalloped-oval cross-section fiber of the invention has given a fabric with exceptional dispersion uniformity, opacity and a soft hand.

Fabrics made from 80%/20% blends of chemical wood pulp with similar scalloped-oval water-dispersible fiber, with a different coating, have demonstrated consistently better opacity than fabrics of various weights of polyester fibers of round cross-section.

From theoretical considerations, water-dispersible fibers of conventional round cross-section would have been expected to give more uniform dispersions, and, therefore, more uniform wet-laid fabrics. This is because the surface energy required to disperse a fiber (or other articles) is given by:

Energy = (Surface Tension) × (Dispersed surface area − Undispersed surface area).

The undispersed fiber exists in logs or clumps of many hundreds of fibers, most of which are on the inside of the logs. Therefore the undispersed surface area is negligible compared to the dispersed area, and the energy term can be expressed approximately as:

Energy = (Surface Tension) × (Number of fibers) × (Surface area of a fiber).

This energy term describes both the energy required to disperse the fiber, and the free energy driving force for reagglomeration. Therefore, for any given coating, and fiber dpf, fibers with lower area would be expected to provide a more uniform dispersion, hence more uniform fabric. The minimum surface area per unit weight for a given fiber occurs when the cross-section is round, which would be expected, therefore, to be preferred.

Surprisingly, however, these scalloped-oval fibers, in spite of about 15% greater surface area gave more uniform fabrics. Without limiting the invention to any theory, this may result from the fiber's hydrodynamic shape, which may more effectively use the energy available in the mixer shear field.

We claim:

1. Water-dispersible polyester fiber provided with a water-dispersing coating in sufficient amount to render the fiber water-dispersible, characterized in that the fibers are of scalloped-oval cross-section.

2. Fiber as claimed in claim 1, wherein the denier is from about 0.5 to about 20.

3. Fiber as claimed in claim 1, of cut length from about 5 to about 90 mm.

4. Fiber as claimed in claim 3, wherein the length-/diameter ratio is from about 100:1 to about 2000:1.

5. Water-dispersible fiber as claimed in claim 4, in the form of a package of cut fiber.

6. Polyester fiber according to claim 1, consisting essentially of poly(ethylene terephthalate).

7. Polyester fiber according to claim 1, coated with a water-dispersible coating consisting essentially of a segmented copolyester of poly(ethylene terephthalate) repeat units and poly(oxyalkylene) groups derived from a poly(oxyalkylene) glycol having an average molecular weight in the range of 300 to 6000.

8. Polyester filaments essentially as claimed in claim 7, except that they are in the form of a continuous filamentary tow.

9. Water-dispersible fiber according to claim 1, wherein the scalloped-oval cross-section is characterized as follows:

a. by major and minor axes of symmetry which are perpendicular to each other;

b. by a ratio of length A to width B, measured along the axes of symmetry, of from 1.4 to 2.4;

c. by a lobe located on each extremity of the major axis which has a tip radius ratio $r_1/R$ of 0.20 to 0.45, where $r_1$ is the radius of the lobe tip and R is the radius of a circle circumscribed about the oblong cross section;

d. by a tip radius ratio $r_2/R$ at each extremity of the minor axis of 0.8 to 2.1 times the tip radius ratio $r_1/R$ of the lobes on the major axis;

e. by indentations between the extremities of the major and minor axes, and;

f. by the shortest distance d between two indentations on opposite sides of the major axis being from 1.2 to 2.0 times the radius $r_1$ of the lobes on the major axis.

* * * * *